US009546455B2

(12) United States Patent
Forbes

(10) Patent No.: US 9,546,455 B2
(45) Date of Patent: Jan. 17, 2017

(54) RIG MAT WITH REPLACEABLE DECK INSERTS

(71) Applicant: Dean Forbes, Calgary (CA)

(72) Inventor: Dean Forbes, Calgary (CA)

( * ) Notice: Subject to any disclaimer, the term of this patent is extended or adjusted under 35 U.S.C. 154(b) by 0 days.

(21) Appl. No.: 14/521,503

(22) Filed: Oct. 23, 2014

(65) Prior Publication Data

US 2016/0115653 A1 Apr. 28, 2016

(51) Int. Cl.

| | |
|---|---|
| ***E01C 9/08*** | (2006.01) |
| ***E01C 5/14*** | (2006.01) |
| ***E01C 11/00*** | (2006.01) |
| ***E01C 11/16*** | (2006.01) |

(52) U.S. Cl.

CPC ..... *E01C 9/086* (2013.01); *E01C 5/14* (2013.01); *E01C 9/083* (2013.01); *E01C 11/005* (2013.01); *E01C 11/16* (2013.01); *E01C 2201/16* (2013.01)

(58) Field of Classification Search

CPC ..... E04C 3/292; E04C 3/18; E04G 1/151; E01C 5/14; E01C 5/22; E01C 11/005; E01C 11/16; E01C 9/086; E01C 9/083; E01C 2201/16

See application file for complete search history.

(56) References Cited

U.S. PATENT DOCUMENTS 1,686,106 A * 10/1928 Saives ..... E04F 15/06 256/45
3,909,145 A * 9/1975 Ayer ..... E01C 9/08 404/40
6,007,271 A 12/1999 Cole et al.
6,089,784 A * 7/2000 Ardern ..... E01C 9/08 403/375
6,746,176 B2 6/2004 Smith
7,565,868 B2 7/2009 Relland
7,604,431 B2 10/2009 Fournier
8,061,929 B2 * 11/2011 Dagesse ..... E01C 9/086 404/34
8,096,728 B2 1/2012 Stasiewich et al.
8,403,593 B2 3/2013 Dagesse
2007/0223993 A1 * 9/2007 Peterson ..... E01O 5/005 403/364
2008/0053343 A1 3/2008 Relland
2009/0087261 A1 4/2009 Fournier
(Continued)

*Primary Examiner* — Abigail A Risic
(74) *Attorney, Agent, or Firm* — Stephen Lewellyn; Maxey Law Offices, PLLC; Kyle Chapin

(57) ABSTRACT

A rig mat frame has at least two longitudinal frame members and at least two lateral frame members defining a deck insert opening therebetween. Each longitudinal frame member has a C-shaped channel facing the deck insert opening and extending along the length of the longitudinal frame member. At least one C-shaped channel has a longitudinally extending flange with a channel opening providing access into the C-shaped channel. A flange panel is removably fastened to the frame and closes the channel opening when the flange panel is fastened to the frame. A plurality of deck inserts are disposed within the frame and extend across the deck insert opening with the ends of each deck insert disposed in the C-shaped channels. And each of the plurality of deck inserts is removable from the C-shaped channels when the deck insert is positioned in alignment with the channel opening and the flange panel is disconnected from the frame.

14 Claims, 9 Drawing Sheets

(56) References Cited

U.S. PATENT DOCUMENTS

| | | | | |
|---|---|---|---|---|
| 2009/0297266 | A1* | 12/2009 | Stasiewich | E01C 9/08 404/36 |
| 2010/0209187 | A1 | 8/2010 | Relland et al. | |
| 2011/0233363 | A1 | 9/2011 | Wold | |
| 2011/0299923 | A1* | 12/2011 | Bleile | E01O 5/001 404/35 |
| 2012/0063844 | A1 | 3/2012 | Wold | |
| 2014/0193196 | A1* | 7/2014 | Fournier | E01C 9/083 404/35 |

* cited by examiner

RIG MAT WITH REPLACEABLE DECK INSERTS

FIELD OF THE INVENTION

The present invention relates generally to rig mats, and more particularly, relating to rig mats with replaceable deck inserts.

BACKGROUND OF THE INVENTION

Rig mats are commonly used in the oil and gas industry as ground cover to provide a platform or road surface to support heavy equipment on otherwise soft ground. There exist several different types of rig mats. One type is often referred to as steel frame mat. A steel frame mat conventionally includes a plurality of steel members that are welded together to form a rectangular frame having a central opening. The frame is configured and welded together in a manner to receive and retain a plurality deck inserts, which are often wooden members. The wooden members extend between sides of the frame and across the central opening, thereby forming the deck surfaces of the rig mat.

Conventional steel frame rig mat construction has many inherent disadvantages. For example, once the rig mat is constructed, the wooden members are essentially permanently held by the frame. This creates a problem because in use the wooden members can be significantly damaged rending the mat unusable. Currently, the only way to replace damaged wooden members is to torch cut the frame so that the damaged wooden members can be removed and replaced. Once the wooden members are replaced, the frame must be welded back together.

Repairing conventional steel frame rig mats is so undesirable that rather than going through the repair process of cutting and welding the frame back together, it is preferable to order a replacement mat, despite the often high costs of shipping the replacement mat to the site location. As such there exists and need for a rig mat construction, which substantially departs from the prior art, and in doing so provides a rig mat construction that allows replacing damaged deck inserts.

SUMMARY OF THE INVENTION

In view of the foregoing disadvantages inherent in the known types of rig mats including now present in the prior art, the present invention provides a new rig mat construction that allows replacing damaged deck inserts.

In general, in one aspect a rig mat is provided. The rig mat includes a panel that has a frame. The frame has at least two longitudinal frame members and at least two lateral frame members defining a deck insert opening therebetween. Each longitudinal frame member has a C-shaped channel facing the deck insert opening and extending along the length of the longitudinal frame member. At least one C-shaped channel has a longitudinally extending flange with a channel opening providing access into the C-shaped channel. A flange panel is removably fastened to the frame and closes the channel opening when the flange panel is fastened to the frame. A plurality of deck inserts are disposed within the frame and extend across the deck insert opening with the ends of each deck insert disposed in the C-shaped channels. And each of the plurality of deck inserts is removable from the C-shaped channels when the deck insert is positioned in alignment with the channel opening and the flange panel is disconnected from the frame.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
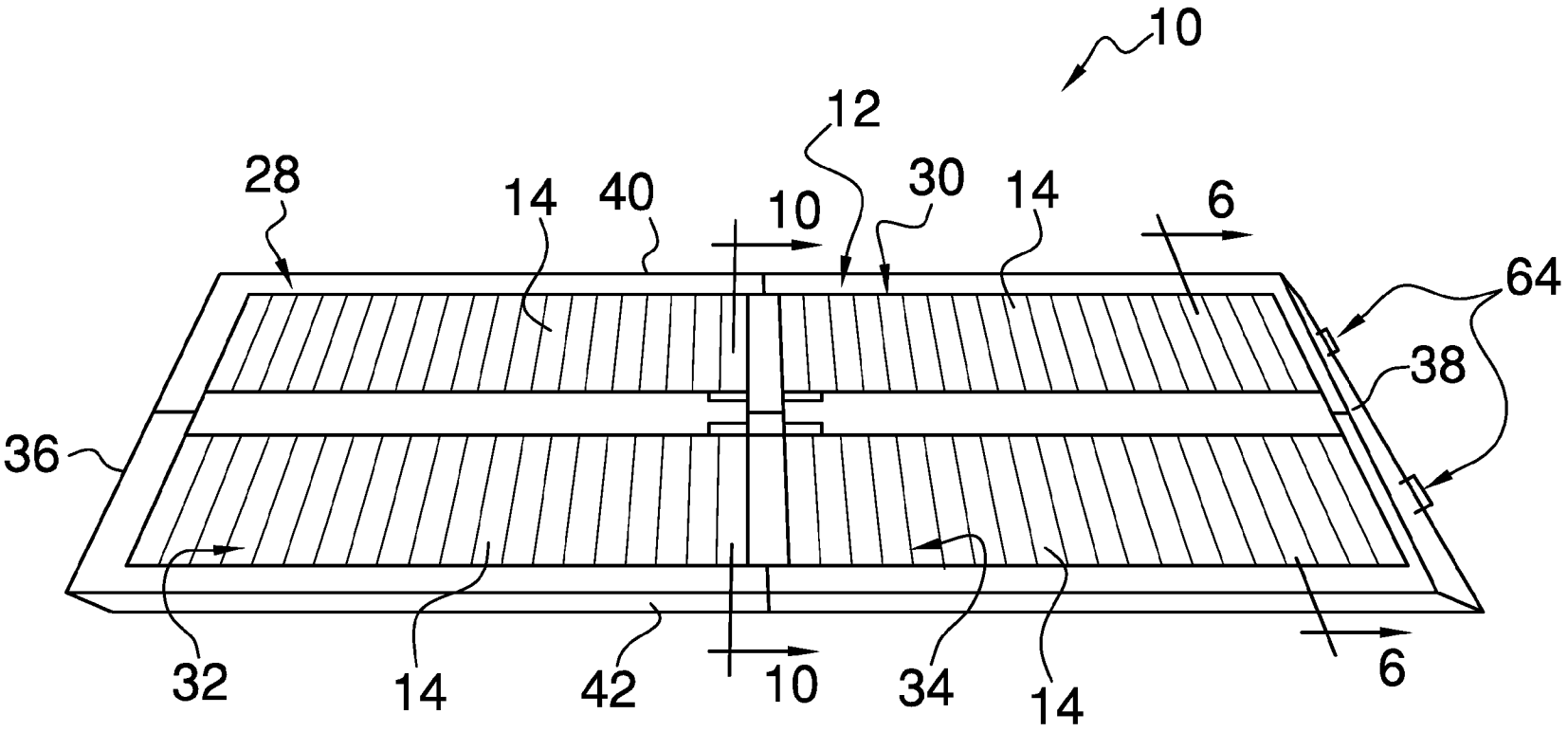
FIG. 1 is a perspective view of a rig mat constructed in accordance with the principles of an embodiment of the present invention.
Figure 2:
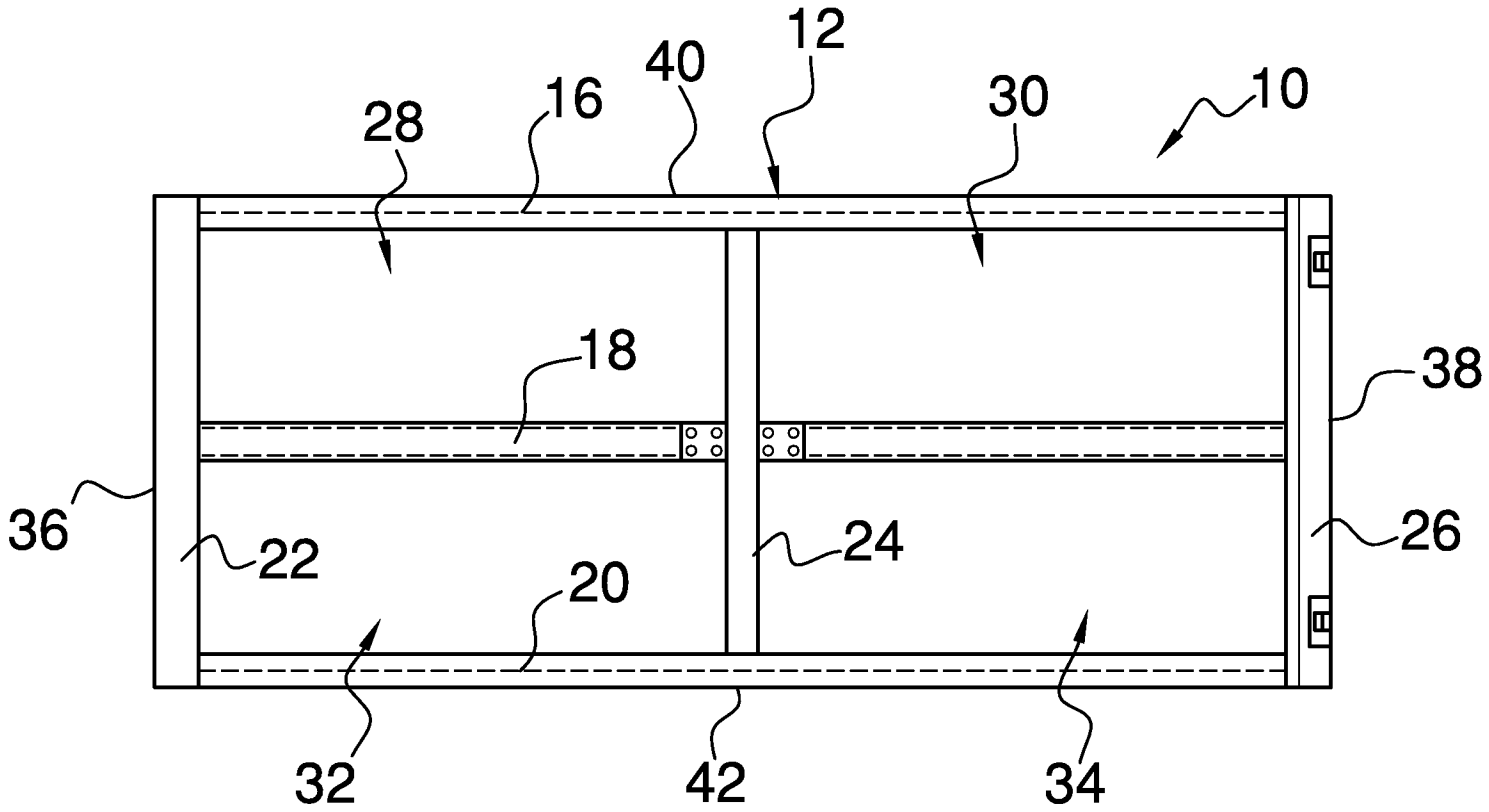
FIG. 2 is a top view of the rig mat, showing a frame construction of the rig mat.
Figure 3:
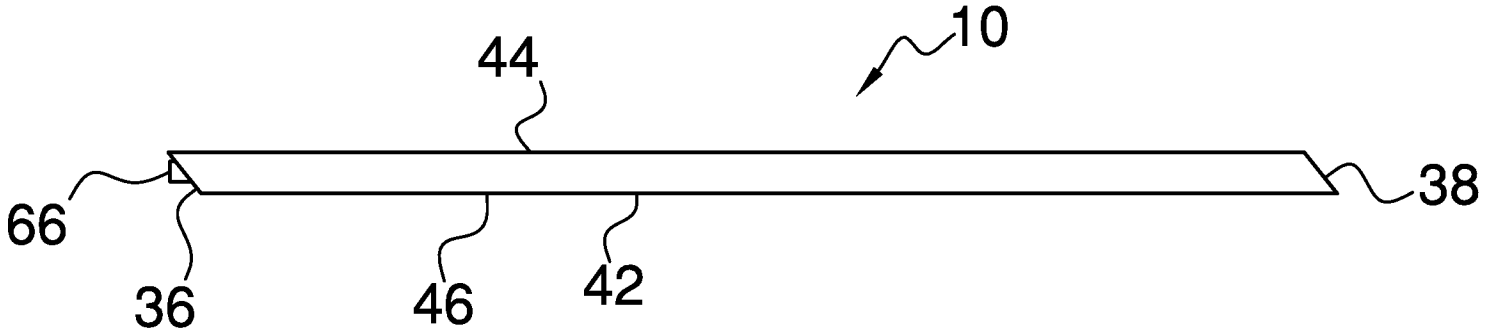
FIG. 3 is a side view of the rig mat.

With reference to FIGS. 1 through 8, there is representatively illustrated a new rig mat 10 in accordance with an embodiment of the present invention. Rig mat 10 comprises a square or rectangular frame 12 having a plurality of intersecting frame members forming a rigid frame structure that holds a plurality of deck inserts 14 that provide the supporting surfaces of the rig mat 10.

More particularly, in the representatively illustrated example, frame 12 includes a plurality of longitudinal frame members 16, 18, and 20 that intersect with a plurality of transverse frame members 22, 24, and 26 to form a rigid, open frame work structure including a plurality of deck insert openings 28, 30, 32, and 34. It is important to note, although frame 26 is shown with four deck insert openings, the frame is capable of having one or more deck insert openings and is not limited the particular illustrated arrangement. And preferably the frame is constructed of metal frame members that are connected together by welding, for example.

In the illustrated example, transverse frame members 22 and 26 form transverse ends 36 and 38 of the rig mat 10. Longitudinal frame members 16 and 20 form longitudinal sides 40 and 42 of the rig mat 10. The rig mat 10 further includes opposite planar surfaces 44 and 46 that are separated by a thickness of the rig mat.

For each deck insert opening, the frame includes two C-shaped channels that are located on opposite sides of the deck insert opening and face inwardly toward the deck insert opening. For example, with reference to FIG. 6, there is illustrated a transverse cross-section of the rig mat 10, which shows deck insert openings 30 and 34. As shown, the frame includes C-shaped channels 48 and 50 that correspond with deck insert opening 30. And the frame includes C-shaped channels 52 and 54 that correspond with deck insert opening 34. In the representatively illustrated example, channels 48 and 50 are provided by longitudinal frame members 16 and 18, and channels 52 and 54 are provided by longitudinal frame members 18 and 20.

A plurality of deck inserts 14 are disposed side-by-side within each deck insert opening and extend across the deck insert opening with opposite ends of each deck insert located within the oppositely facing and corresponding C-shaped channels.

Figure 7:
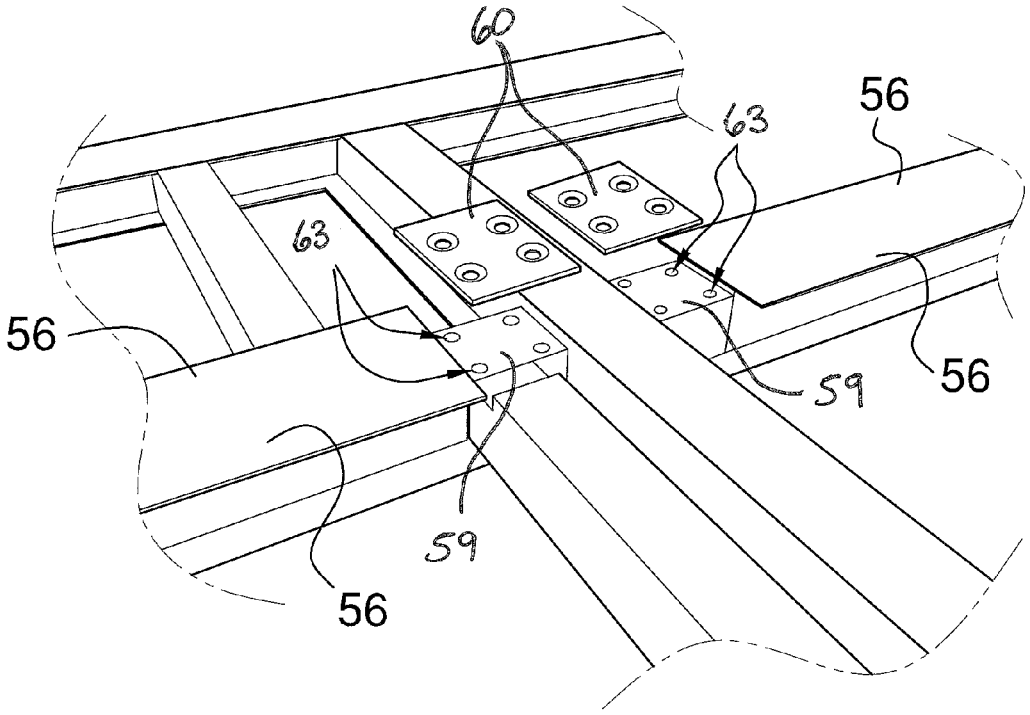
FIG. 7 an enlarged, partial perspective view of the rig mat, showing a configuration of the frame for inserting and removing deck inserts into the frame of the rig mat.

With reference to FIG. 7, at least one C-shaped channel of the two channels that correspond with each deck insert opening includes a top flange 56 that has a flange opening 58 that provides access to the C-shaped channel in a direction from one of the planar surfaces of the rig mat. The flange opening 58 allows inserting and removing deck inserts 14 from frame 12, and more particularly, from corresponding C-shaped channels when a deck insert is positioned in alignment with the flange opening. That is, when a deck insert is aligned with the flange opening, the insert can be pivoted into or out of the channels by passing the corresponding end of the deck insert through the flange opening. Deck inserts 14 are sized relative to the C-shaped channels such that the deck inserts are slidable along the channels to allow inserting and removing them from the channels.

Figure 8:
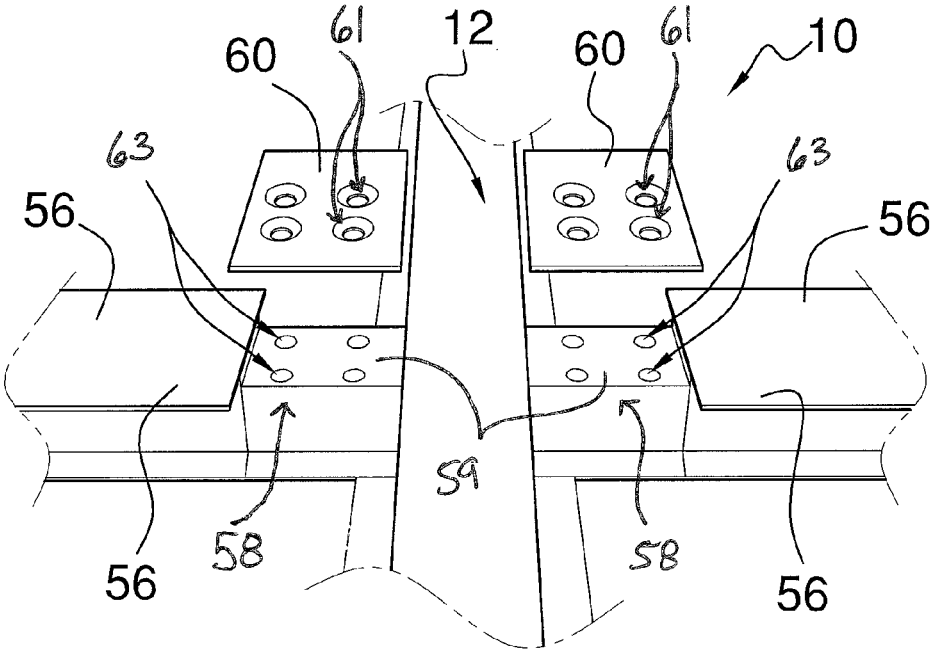
FIG. 8 is an enlarged, partial perspective view of the rig mat, showing flange plates exploded from the frame, revealing flange openings.
Figure 9:
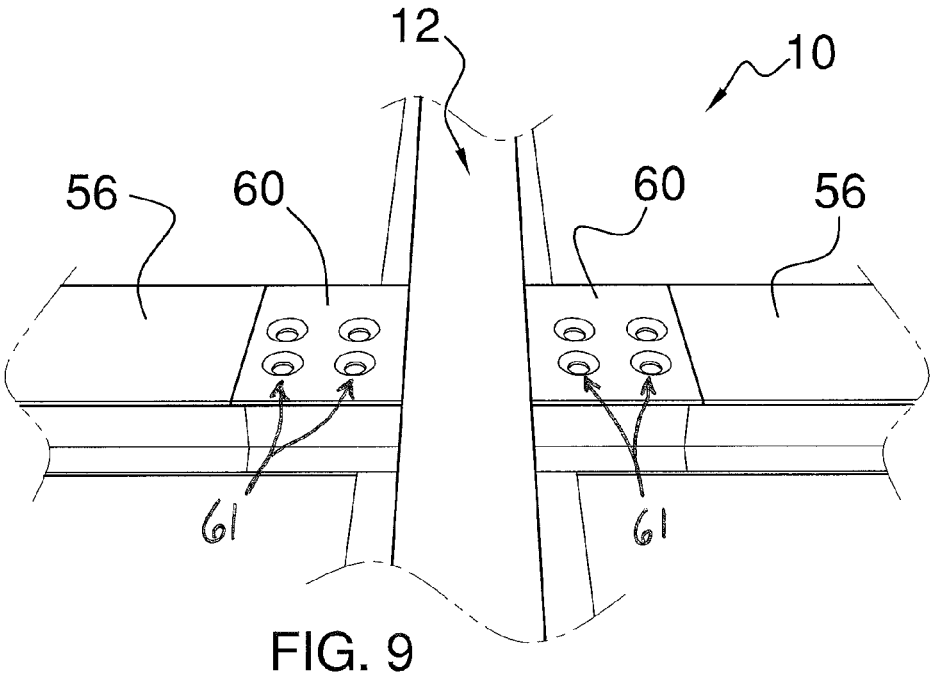
FIG. 9 is an enlarged, partial perspective view of the rig mat, showing flange plates secured to the frame and closing flange openings.
Figure 10:
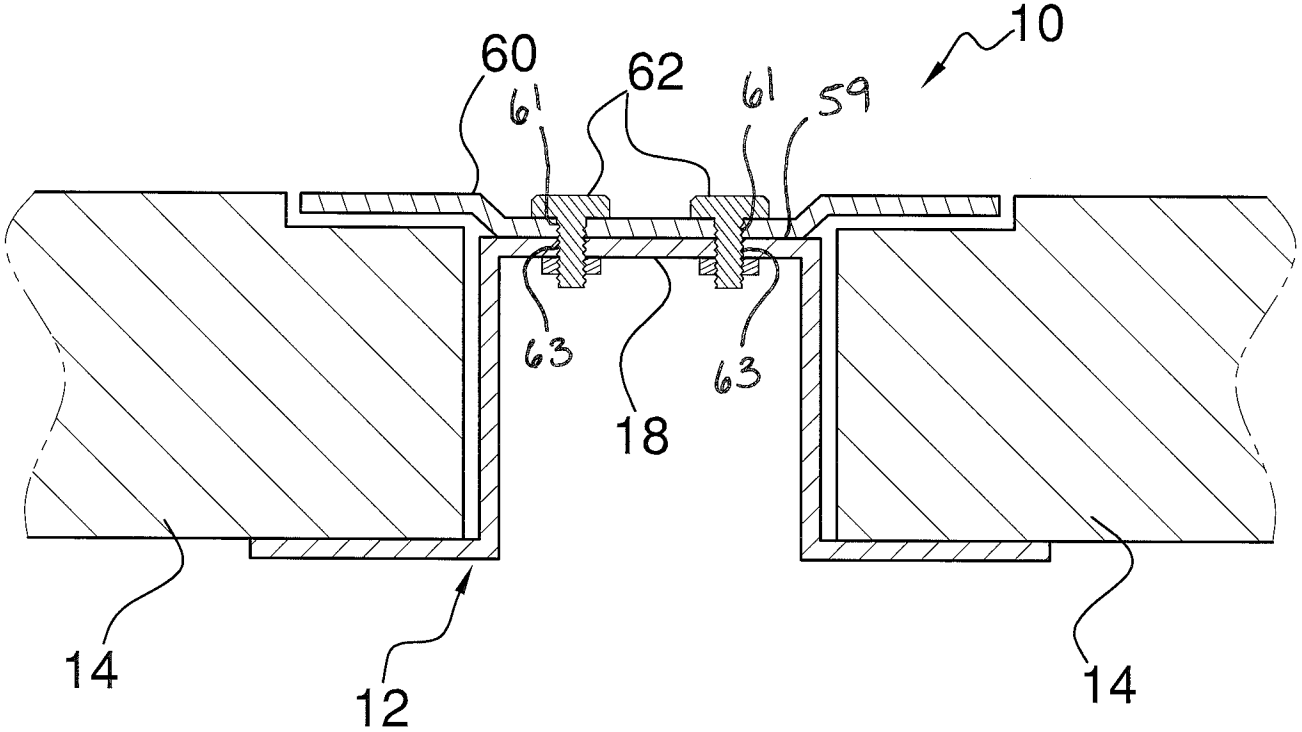
FIG. 10 is a cross-section view taken along line 10-10 in FIG. 1, showing a flange plate secured to the frame by threaded fasteners.

With further reference to FIGS. 8-10, the rig mat 10 further includes a flange panel 60 that is removably fastened to the frame 12 and closes the flange opening 58 when the flange panel is fastened to the frame. When the flange opening 58 is closed off by a flange panel 60, deck inserts 14 cannot be removed from or inserted into corresponding C-shaped channels. In the representatively illustrated example, the rig mat 10 includes two flange panels 60, one for two flange openings 58. And the flange panels 60 are removably fastened to the frame 12 by threaded fasteners, such as bolts 62.

Figure 4:
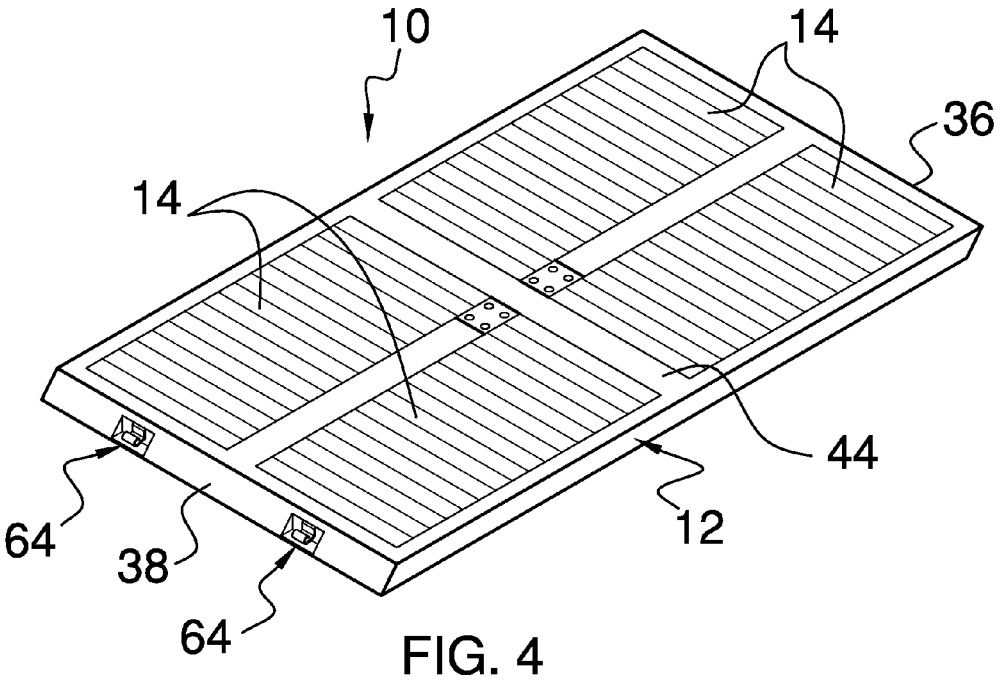
FIG. 4 is a perspective view of the rig mat, showing one transverse end and one planar surface of the rig mat.
Figure 5:
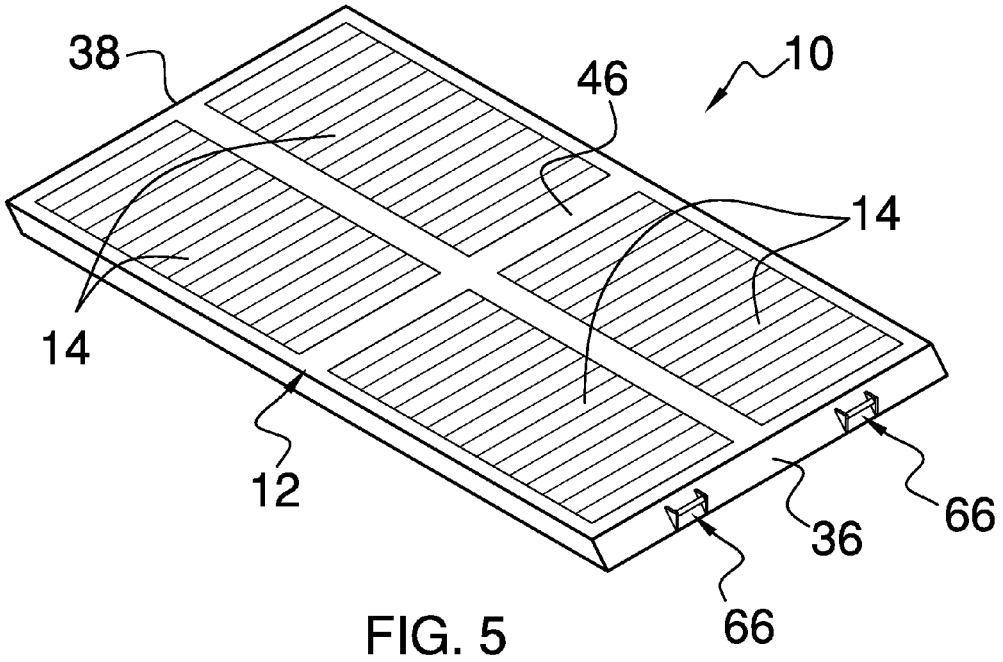
FIG. 5 is a perspective view of the rig mat, showing the opposite transverse end and opposite planar surface of the rig mat.
Figure 6:
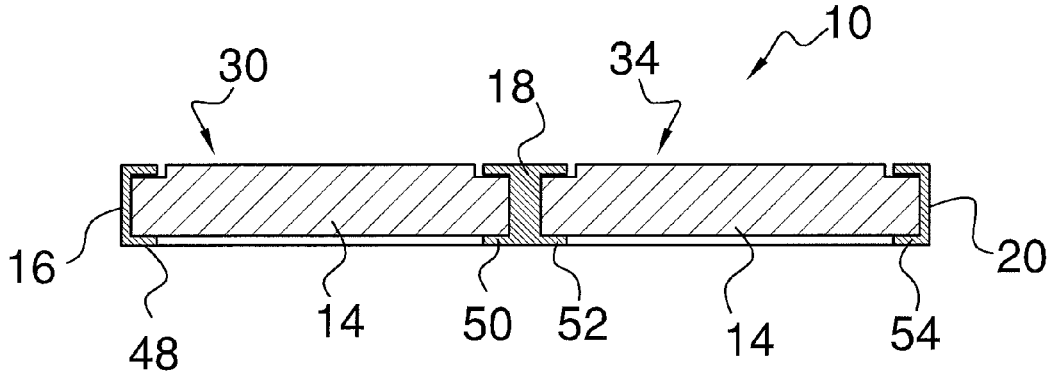
FIG. 6 is a cross-section view of the rig mat taken along line 6-6 in FIG. 1.
Figure 11:
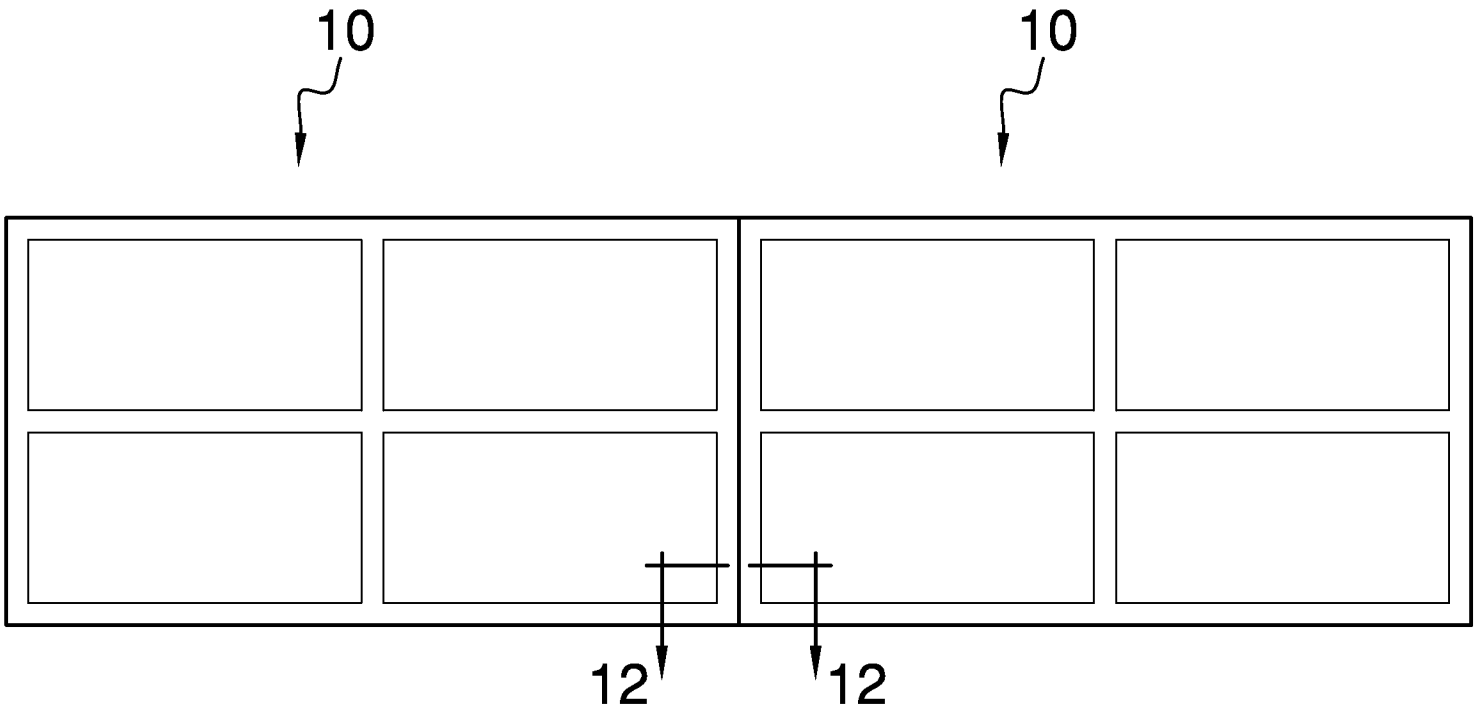
FIG. 11 is a diagrammatic view showing a rig mat system including two rig mats connected together end-to-end.
Figure 12:
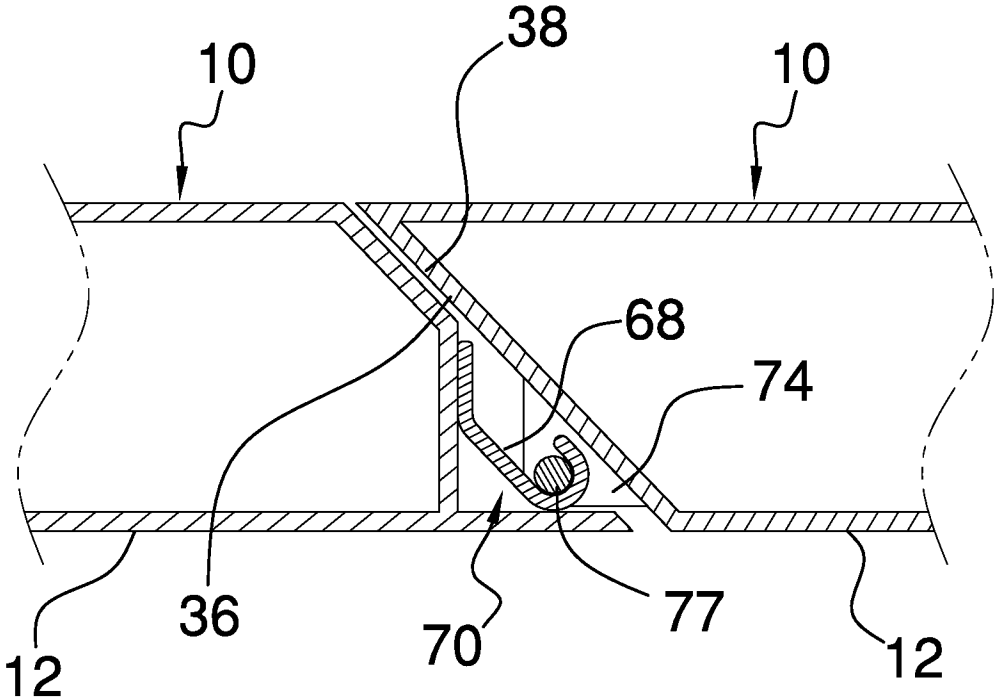
FIG. 12 is a cross-section view taken along line 12-12 in FIG. 11, showing the connection between the two rig mats illustrated in FIG. 11.

The rig mat 10 further includes an interlock system for connecting multiple rig mats together. As best seen in FIGS. 4 and 5, rig mat 10 includes one or more first interlock members 64 along transverse end 38 and one or more cooperating second interlock members 66 along the opposite transverse end 36. First and second interlock members 64 and 66 are configured to cooperatively and releasably engage with one another to connect the ends of adjacently positioned rig mats, FIGS. 11 and 12.

In the representatively illustrated example, the first interlock member 64 comprises a hook member 68 disposed within a recess 70 formed into transverse end 36 and the second interlock member 66 comprises a striker bolt 72 supported between spaced plates 74 that are mounted to transverse end 36. Further, in the representatively illustrated example, transverse ends 36 and 38 are oppositely angled such that the opposite ends of two rig mats overlap one another when placed together, which prevent undesirable gaps between the adjacent ends.

A number of embodiments of the present invention have been described. Nevertheless, it will be understood that various modifications may be made without departing from the spirit and scope of the invention. Accordingly, other embodiments are within the scope of the following claims.

What is claimed is:

1. A rig mat comprising:

a panel including a frame, the frame having at least two longitudinal frame members and at least two lateral frame members defining a deck insert opening therebetween;

each longitudinal frame member having a C-shaped channel facing the deck insert opening and extending along the length of the longitudinal frame member;

at least one of said C-shaped channels having a longitudinally extending flange with a flange opening providing access into the C-shaped channel;

at least one of said longitudinal frame members having a flange panel mounting surface extending along said flange opening;

a flange panel removably fastened to said flange panel mounting surface with said flange panel overlapping said flange mounting surface by one or more threaded fasteners extending through cooperating holes formed through said flange panel and said flange mounting surface; and wherein said flange opening is closed when said flange panel is mounted along said flange panel mounting surface.

2. The rig mat of claim 1, further comprising:

a first interlock member on a first end of the panel for connection to an adjacent panel; and a second interlock member on a second end of the panel for connection to an adjacent panel.

3. The rig mat of claim 1, further comprising:

a plurality of deck inserts disposed within the frame and extending across the deck insert opening with the ends of each deck insert disposed in the C-shaped channels; and wherein each of the plurality of deck inserts is removable from the C-shaped channels when the deck insert is positioned in alignment with the flange opening and the flange panel is disconnected from the flange panel mounting surface.

4. The rig mat of claim 3, wherein the ends of each deck insert are notched.

5. The rig mat of claim 3, wherein one or more of the plurality of deck inserts are wooden.

6. A rig mat system comprising, a plurality of panels arranged to be disposed end-to-end in an array to cover a ground surface to form a support;

each panel including:

a frame having at least two longitudinal frame members and at least two lateral frame members defining a central opening therebetween;

each longitudinal frame member having a C-shaped channel facing the central opening and extending along the length of the longitudinal frame member;

at least one of said C-shaped channel having a longitudinally extending flange with a flange opening providing access into the C-shaped channel;

at least one of said longitudinal frame member having a flange panel mounting surface extending along said flange opening;

a flange panel removably fastened to said flange panel mounting surface with said flange panel overlapping said flange mounting surface by one or more threaded fasteners extending through cooperating holes formed through said flange panel and said flange mounting surface;

wherein said flange opening is closed when said flange panel is mounted to said flange panel mounting surface;

a plurality of deck inserts disposed within the frame and extending across the central opening with the ends of each deck insert disposed in the C-shaped channels; and wherein each of the plurality of deck inserts is removable from the C-shaped channels when the deck insert is positioned in alignment with the flange opening and the flange panel is disconnected from the frame.

7. The rig mat of claim 6, wherein the ends of each deck insert are notched.

8. The rig mat system of claim 6, wherein each panel includes an interlock member for connecting an end of the panel to a next adjacent panel.

9. The rig mat of claim 6, wherein one or more of the plurality of deck inserts are wooden.

10. A rig mat comprising a panel having a frame;

the framing defining at least one central opening and two C-shaped channels facing the central opening and extending along opposite sides of the central opening;

at least one of said C-shaped channel having a longitudinally extending flange with a flange opening providing access into the C-shaped channel;

said frame having a flange panel mounting surface extending along said flange opening;

a flange panel removably fastened to said flange panel mounting surface with said flange panel overlapping said flange mounting surface by one or more threaded fasteners extending through cooperating holes formed through said flange panel and said flange panel mounting surface; and wherein said flange opening is closed when said flange panel is mounted to said flange panel mounting surface.

11. The rig mat of claim 10, further comprising:

a first interlock member on a first end of the panel for connection to an adjacent panel; and a second interlock member on a second end of the panel for connection to an adjacent panel.

12. The rig mat of claim 10, further comprising:

a plurality of deck inserts disposed within the frame and extending across the at least one central opening with the ends of each deck insert disposed in the C-shaped channels; and wherein each of the plurality of deck inserts is removable from the C-shaped channels when the deck insert is positioned in alignment with the flange opening and the flange panel is disconnected from the flange panel mounting surface.

13. The rig mat of claim 12, wherein the ends of each deck insert are notched.

14. The rig mat of claim 12, wherein one or more of the plurality of deck inserts are wooden.

* * * * *